United States Patent [19]

Lileev et al.

[11] 4,378,820

[45] Apr. 5, 1983

[54] APPARATUS FOR BEATING-UP WEFT THREAD IN TRAVELLING WAVE SHEDDING LOOMS

[76] Inventors: Valerian P. Lileev, ulitsa Nagornaya, 46/48, korpus 20, kv. 2; Eduard A. Onikov, ulitsa Panferova, 5, korpus 2, kv. 106; Alexandr A. Zabotin, ulitsa Profsojuznaya, 96, kv. 85, all of Moscow, U.S.S.R.

[21] Appl. No.: 195,985

[22] Filed: Oct. 10, 1980

[51] Int. Cl.[3] ..... D03D 47/26

[52] U.S. Cl. ..... 139/436

[58] Field of Search ..... 139/436, 188

[56] References Cited

U.S. PATENT DOCUMENTS

| | | | |
|---|---|---|---|
| 3,705,606 | 12/1972 | Stucki | 139/439 |
| 4,037,628 | 7/1977 | Komarov et al. | 139/436 |
| 4,071,052 | 1/1978 | Vasek et al. | 139/436 |

FOREIGN PATENT DOCUMENTS

| | | | |
|---|---|---|---|
| 2017767 | 10/1979 | United Kingdom | 139/436 |

*Primary Examiner*—Henry Jaudon

*Attorney, Agent, or Firm*—Steinberg & Raskin

[57] ABSTRACT

An apparatus for beating-up weft thread to be used in traveling wave shedding looms comprises a stationary reed for dividing warp threads and a rotary shaft having plates secured thereto and forming combs arranged helically along the shaft. The plates of at least one comb are made and arranged relative to plates of other combs in such a manner that planes of revolution of at least a portion of each plate of the comb, during rotation of the shaft, are displaced along the shaft away from the plane of revolution of plates of other combs. This arrangement of plates enables the maintenance of warp threads in the position set-up by the dividing reed, thereby improving quality of cloth being manufactured.

5 Claims, 12 Drawing Figures

APPARATUS FOR BEATING-UP WEFT THREAD IN TRAVELLING WAVE SHEDDING LOOMS

FIELD OF THE ART

The present invention relates to travelling wave shedding looms, and more specifically to apparatus for beating-up weft thread in such looms. The invention may be most advantageously used for making medium and high density cloth with high yarn count.

BAKGROUND OF THE INVENTION

Known in the art are apparatus for beating-up weft thread in a loom, comprising a stationary reed for dividing weft threads and a rotary shaft having plates for beating-up weft thread against the fell of fabric, the warp threads extending in the interstices between the plates.

All such known apparatus may be divided into three groups.

The first group includes apparatus wherein plates are spaced apart along a shaft (e.g., see apparatus disclosed in USSR Inventor's Certificate No. 185770, Cl 86c, 14/01; German Pat. Nos. 2120626, 2338238, Cl. D 03 D 47/26). The plates have slots for engaging and transfering weft thread to the fell of fabric, and warp threads extend in the interstices between the plates. The plates are so shaped as to prevent the warp threads from being displaced from one interstice between the plates to another. To prevent the warp threads from being displaced through the slots, the slots are of minimum width approximately the thickness of the weft thread or plate.

An apparatus of such type requires, however, manual division of warp threads over the interstices between the plates when the warp yarn is loaded and manual restoration of a pre-set division of the threads between the plates when the pattern has been broken during the weaving under the action of various accidental factors.

The second group includes apparatus wherein plates having one or several radial projections are spaced apart along a shaft (e.g., see apparatus disclosed in German Pat. No. 2621528, Cl. D 03D 47/26).

A free space between the plate projections enables an axial movement of the warp threads along the shaft and displacement thereof from one interstice between the plates to another. For uniform distribution of warp threads between the plates, the plates are mounted opposite to the teeth of a dividing reed and are arranged so close thereto that a space defined therebetween is about equal to the reed tooth thickness. There is no space between the plates and the dividing reed to accommodate therebetween a mechanism for moving shuttles in the shed so that the beat-up mechanism becomes complicated as it must also cause the shuttles to move.

The third group includes an apparatus (e.g., see apparatus disclosed in USSR Inventor's Certificate No. 109552, Cl. 86c, 27/02 which is the prototype of the invention), comprising a stationary reed for dividing warp threads and a rotary shaft having beat-up plates secured thereto between which warp threads run. The plates are secured to the shaft in such a manner as to define combs extending helically along the shaft which cause weft threads to move toward the fell of fabric. A zone for accommodating a mechanism for moving shuttles in the shed is arranged between the stationary reed and the beat-up plates. The plates of any comb define the same planes of revolution as the plates of other combs thus preventing misaligned warp threads from returning into the position determined by the dividing reed.

SUMMARY OF THE INVENTION

It is an object of the invention to provide an apparatus for beating-up weft thread in a travelling wave shedding loom in which plates are so arranged in combs as to ensure the return of misaligned warp threads back to the position set-up by a dividing reed without bringing the reed teeth closer to the zone of rotation of the beat-up plates, without complicating the apparatus.

Another object of the invention is to improve the quality of manufactured cloth.

With these and other objects in view, in an apparatus for beating-up weft thread in a travelling wave shedding loom, comprising a stationary reed for dividing warp threads, a rotary shaft having plates secured thereto and defining combs extending helically along the shaft, according to the invention, each plate of at least one comb is made and arranged relative to each plate of another comb in such a manner that, during rotation of the shaft, the plane of revolution of at least a portion of each plate of the comb is displaced along the shaft away from the planes of revolution of plates or other combs.

This arrangement of plates in the combs increases the number of planes in which the plates rotate, e.g. twice, without reducing the space between the plates in any comb. An increase in the number of planes of revolution of the plates enables the displacement of the misaligned warp threads in the direction along the axis of the beat-up shaft until the warp threads are in a position between the plates as set-up by the dividing reed, since the greater the number of planes of revolution in which plates of the combs are arranged per unit of the cloth width the better the parallelism of the warp threads.

The invention is also characterized in that plates of at least one comb are arranged opposite to the teeth of the stationary reed and have the same spacing. This arrangement of the plates is preferable in making cloth in which the pattern of warp threads between the plates should be identical to their pattern between the reed teeth.

The combs in which planes of revolution of the plates are different should be spaced apart in such a manner that the distance from the axis of rotation of the shaft to an imaginary line tangent to the plates of these comb should be greater than the distance to the shed branch which is the most remote from the axis of rotation of the shaft. This arrangement of combs permits the plates of one comb to disengage from the warp threads only after the plates of another comb engage the warp threads so that the parallelism of the warp threads established before the action of the next comb on the warp threads is maintained.

In accordance with one embodiment of the apparatus, an edge of the plate which is most remote from the axis of rotation of the shaft does not extend in parallel with the plane of revolution of the plate. This makes it possible to accomplish the object of the invention even with an inaccurate installation of plates on the shaft and to simplify the assembly of the shaft and plates.

The invention is also characterized in that the plates of various combs are made in the form of an integral member having a common base so as to simplify the assembly of the shaft and plate and reduce the manufacturing cost.

Therefore, the apparatus for beating-up weft thread in a travelling wave shedding loom according to the invention improves the weaving process, ensures the maintenance of the warp threads division pattern as set-up by the reed and makes it possible to produce medium and high density cloth without structural flaws.

BRIEF DESCRIPTION OF THE DRAWINGS

The invention will now be described in detail to illustrate the apparatus for beating-up weft threads in a travelling wave shedding loom with reference to the accompanying drawings, in which.

DETAILED DESCRIPTION OF THE INVENTION

Figure 2:
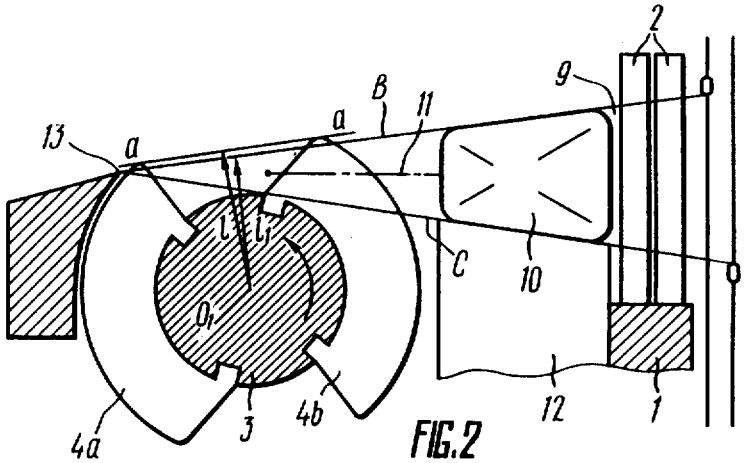
FIG. 2 is a view of the apparatus along arrow A in FIG. 1, with the helical arrangement of combs along the shaft not being shown for the sake of clarity.
Figure 3:
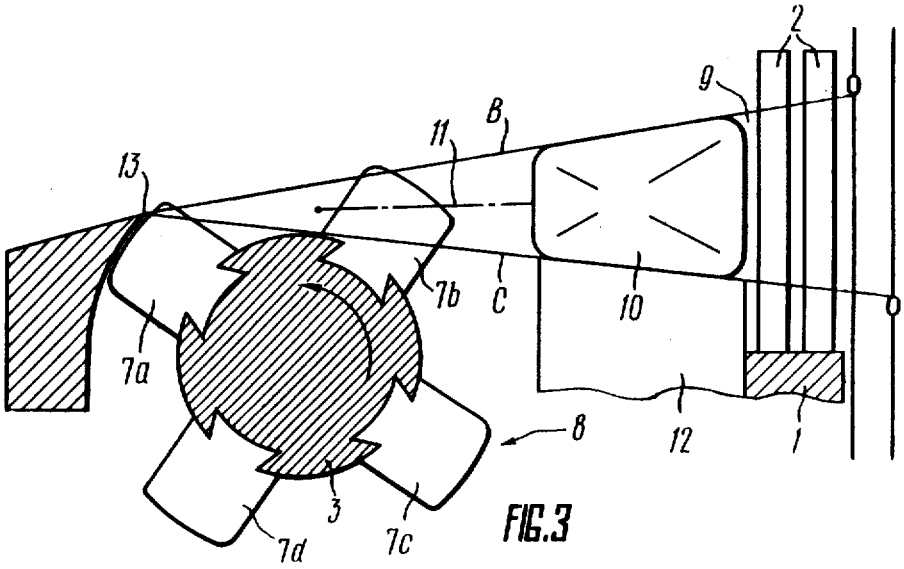
FIG. 3 shows an embodiment of the shaft of the apparatus of FIG. 1 in a side elevation view, with four plates forming combs, the helical arrangement of combs along the shaft not being shown for the sake of clarity.

An apparatus for beating-up weft thread in a travelling wave shedding loom comprises a stationary reed 1 (FIGS. 1, 2 and 3) having two rows of teeth 2, a rotary shaft 3 carrying plates, e.g. two plates 4*a* and 4*b* (as in FIGS. 1 and 2) forming two combs 5 and 6, respectively, or four plates 7*a*, 7*b*, 7*c*, 7*d* (as shown in FIG. 3) defining four combs 8, respectively, the plates being arranged in their combs at a pre-set spacing and displaced relative to one another so that the combs 5 and 6 (FIG. 1) or 8 (not shown in the drawing) are arranged helically along the shaft 3.

Between the teeth 2 (FIGS. 2 and 3) of the stationary reed 1 run warp threads defining a shed 9. Between branches B and C of the shed 9 travel shuttles 10 guiding weft threads 11, both the shuttles 10 and a mechanism 12 for moving the shuttles 10 being arranged between the stationary reed and the shaft 3. The shuttles 10 and the mechanism 12 may be of any appropriate known type, e.g. of the type described in German Pat. No. 2447277, Cl. D 03 D, 47/26. Each plate 4*a*, 4*b* or 7*a*, 7*b*, 7*c*, 7*d* is designed to engage the weft thread 11, moving it to a fell 13 of fabric from the zone of its guiding by the shuttle 10 and for beating-up the thread 11 against the fell 13 of fabric. The direction of rotation of the shaft 3 is shown by arrows in all Figures.

As is conventional, the branches B and C of the shed 9 more vertically to form an open shed into which the weft thread is placed and in which weft thread carriers move. The branches of the shed are constantly alternating their positions in a wave-like motion in respective substantially horizontal planes during the cloth making operation as is convention.

Figure 1:
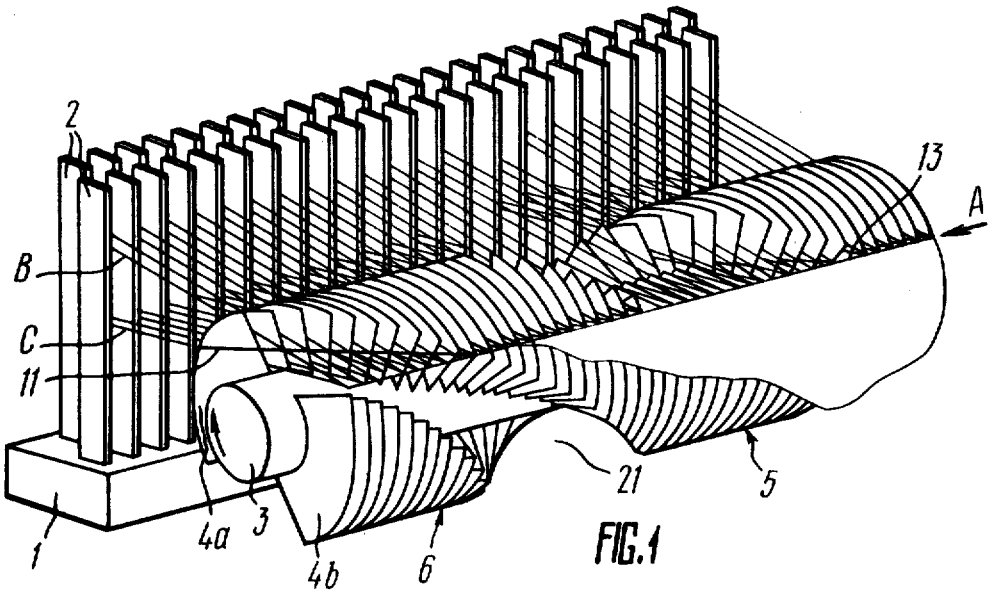
FIG. 1 is a diagrammatic perspective general view of an apparatus for beating-up weft thread, having two combs.

In the apparatus according to the invention the plates of at least one comb are made and arranged relative to plates of other combs in such a manner that, during rotation of the shaft 3 the plane of revolution of at least a portion of each plate or of the whole plate is displaced along the shaft away from the planes of revolution of plates of other combs and is parallel therewith. Thus, as shown in FIGS. 1, 2 and 4*a*, the plates 4*b* of the comb 6 are arranged on the shaft 3 in a displaced position relative to and in parallel with the plates 4*a* of the comb 5 so that, during rotation of the shaft 3, the plates 4*a* and 4*b* of the combs 5 and 6, respectively, form parallel planes of revolution D and E, the plates 4*a* and 4*b* being secured to the shaft 3 by any known method, e.g. as shown in FIG. 2 or 3.

Figures 4A, 4B, 4C, 4D, 4E, 4F:
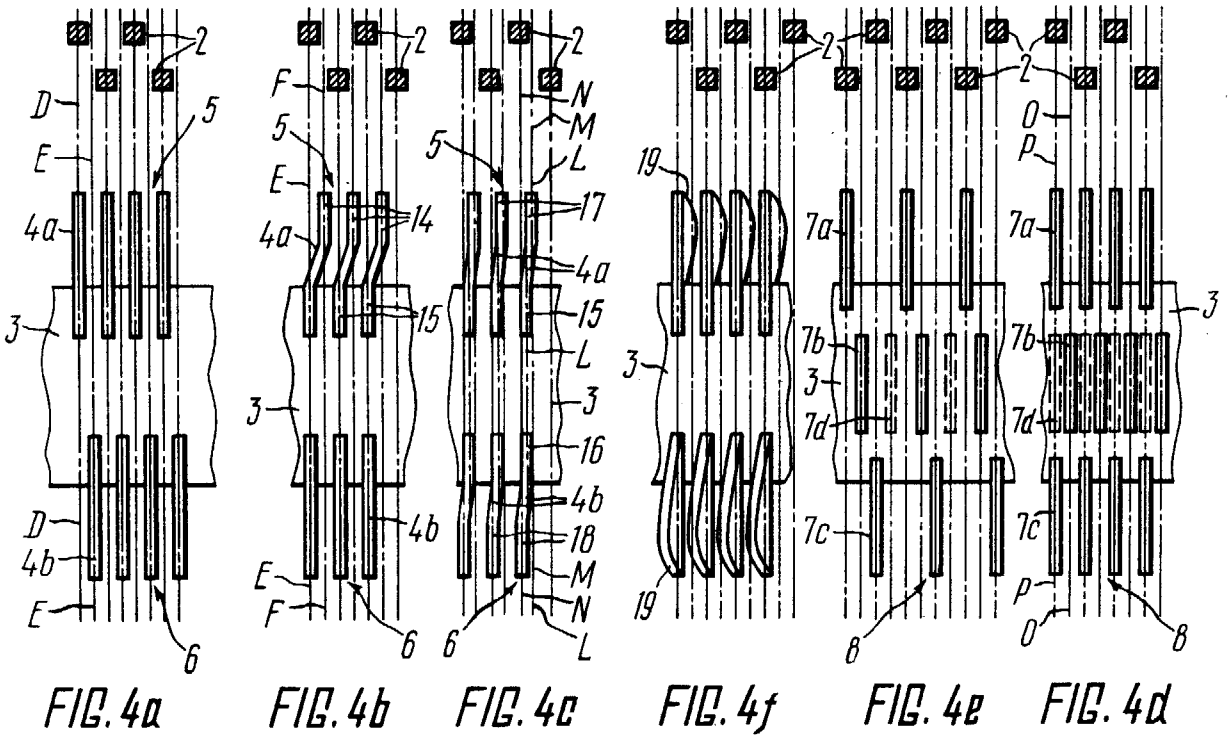
FIGS. 4*a* through 4*f*, show various embodiments and arrangements of plates on the shaft of the apparatus shown in FIGS. 1 and 3, the helical arrangement of combs on the shaft not being shown for the sake of clarity.

According to the invention, as shown in FIG. 4*b*, a portion 14 of each plate 4*a* of the comb 5 which is the most remote from its base 15 is displaced relative to the base 15 of the plate 4*a* and extends in parallel therewith. The base 15 of the plate 4*a* is at the same level with the plate 4*b* of the comb 6 since it is arranged in the same plane of revolution E.

As a result, during rotation of the shaft 3 the plane of revolution F of the portion 14 of each plate 4*a* is displaced along the shaft away from the planes of revolution E of the plate 4*b*.

As shown in FIG. 4*c*, the bases 15 and 16 of the plates 4*a* and 4*b*, respectively, of the combs 5 and 6 extend in one and same plane L, and portions 17 and 18 of these plates which are most remote from their bases are displaced, e.g. bent away in opposite directions and take a position shown in FIG. 4*c*. During rotation of the shaft 3 planes M of revolution of the portion 17 of the plate 4*a* are displaced along the shaft away from the planes N of revolution of the portion 18 of the plate 4*b* and to the planes L in which the bases 15 and 16 of the extend.

In the apparatus shown in FIG. 3 there are four combs 8 formed by the plates 7*a*, 7*b*, 7*c* and 7*d*. According to the invention, the plates, such as the plate 7*b* of one of the combs 8 as shown in FIG. 4*d* are displaced relative to the plates 7*a*, 7*c* and 7*d* of the remaining combs 8 which are arranged in one and the same plane, whereby the plane O of revolution of each plate 7*b* is displaced along the shaft away from the plane P of revolution of the plates 7*a*, 7*c* and 7*d*.

As shown in FIG. 4*e*, the plates 7*b*, 7*c* and 7*d* of the combs are displaced relative to and extend in parallel with not only the plates 7*a* but also relative to one another so that, during rotation of the shaft 3, the planes of revolution of the plates 7*a*, 7*b*, 7*c* and 7*d* of all combs 8 extend in parallel with one another. In addition, each of the plates 7*a*, 7*b*, 7*c* and 7*d* of the combs 8 may be constructed as shown in FIGS. 4*b* and 4*c*.

Regardless of the number of combs formed by the plates on the shaft 3, i.e. whether two (FIGS. 1 and 2) or four (FIG. 3) combs are formed by the plates, all these plates may be made as shown in FIG. 4*f*, that is so an edge 19 of the plate which is the most remote from the axis of rotation of the shaft 3 does not extend in parallel with the plane of revolution of the plate.

The combs 5 and 6 (FIG. 1) in which the planes of revolution D and E of the plates 4*a* and 4*b* extend in parallel with one another are spaced apart in such a manner that the distance "1" (FIG. 2) from the axis $O_1$ of rotation of the shaft 3 to an imaginary line "a—a" tangent to the plates 4*a* and 4*b* of the combs 5 and 6 is greater than the distance "$\mathbf{1}_1$" to the weft thread B in the largest shed 9 most remote from the axis of rotation of the shaft 3. The same condition is fulfilled in the case where the shaft 3 is made with four combs.

To improve the quality of cloth, the plates 4*a*, 4*b* and 7*a* through 7*d* of at least one comb are installed opposite to the teeth 2 of the stationary reed 1 as shown in FIGS. 4*a* through 4*f* and are mounted at the same spacing, while the plates of other combs may be arranged in the interstices between the teeth 2 of both rows of the stationary reed as shown in FIGS. 4*a* through 4*f*.

Figures 5A, 5B:
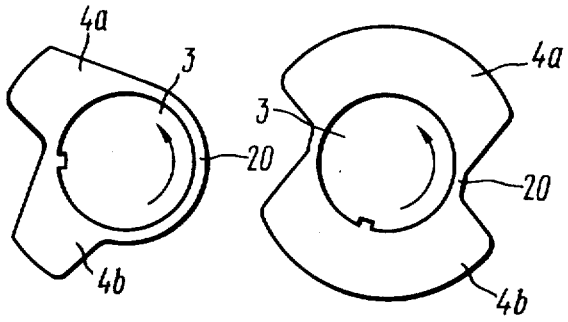
FIGS. 5*a* and 5*b* show plates of different combs made as a single integral part.

In the embodiments illustrated in FIGS. 5*a* and 5*b*, the plates 4*a* and 4*b* forming respective combs 5 and 6 are rigidly interconnected to form an integral member having a base 20, the shape of the plates being a matter of design. At the same time, their planes of revolution should correspond to FIGS. 4*a* through 4*c*.

The plates 7*a* through 7*d* of the combs 8 may also be made in the form of an integral member (not shown), or they may be arranged in pairs on a common base as shown in FIG. 5*a*. The planes of revolution of such plates should be as shown in FIGS. 4*d* and 4*e*.

The apparatus for beating-up weft thread functions in the following manner.

The warp threads B and C divided by the teeth 2 of the stationary reed 1 are applied to the plates 4*a* and 4*b* of the shaft 3 without any strict division thereof between the plates.

The warp threads are divided in the interstices between the plates 4*a* and 4*b* in a pattern set-up by the teeth of the reed 1 in the following manner.

Figure 6:
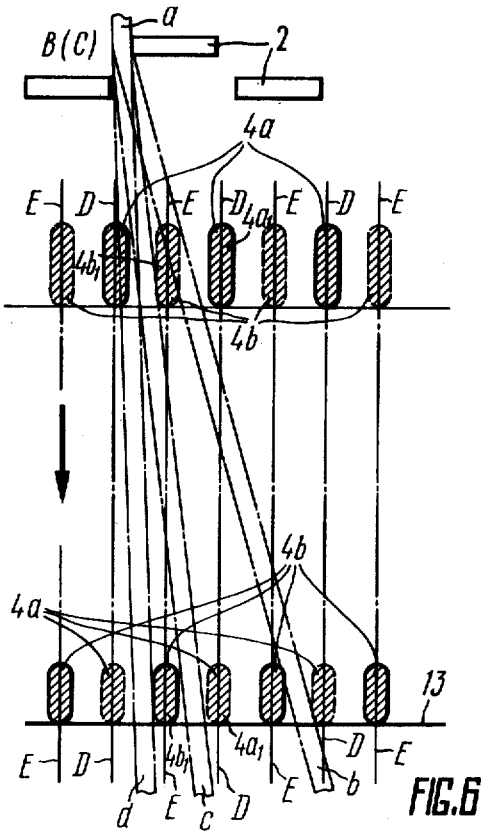
FIG. 6 schematically shows the process of returning warp threads by the plates back to the position set-up by the dividing reed.

Referring to FIG. 6, misaligned warp threads in a position "ab" are engaged by the plates 4*a* during rotation of the shaft 3 (the plate engaging the thread in the position "ab" is referred to as the plate $4a_1$). During rotation of the shaft 3 the plate $4a_1$ moving toward the fell 13 of fabric in its plane of revolution D engages the warp thread B (C), causes it to move from the position "ab" to a position "ac" (the position of the plate $4a_1$ as the position of all plates 4*a* in the vicinity of the fell 13 of fabric is shown with dotted lines) and holds it in this position.

When next plates 4*b* approach the level of the upper branches of the shed (where they are shown with dotted lines) the warp thread B(C) which is in the position "ac" is engaged by the plate $4b_1$ extending in the plane of revolution E and is caused to move thereby to a position "ad". By that time the plate $4a_1$ that has been so far in the vicinity of the fell 13 of fabric disengages from the warp threads so as not to interfere with the displacement of the warp thread B (C) from the position "ac" to the position "ad". Therefore, misaligned warp threads are caused to move to a position in which they extend in parallel with the plane of revolution of the plates axially along the shaft.

Displacement of the warp threads axially along the shaft 3 (FIG. 1) under the action of the plates 4*a* and 4*b* is possible owing to the fact that a helical groove 21 between the combs 5 and 6 is of a depth such that the threads move without undergoing strong deformations.

The weft thread 11 is beaten-up in a known way. The weft thread guided by the shuttle 10 to the groove 21 is engaged by the sides of the plates 4*a* and 4*b* and, owing to the helical configuration of the groove, is gradually caused to move by these plates toward the fell 13 of fabric for beating-up.

The apparatus shown in FIG. 3 functions in the same manner as described above.

What is claimed is:

1. An apparatus for beating-up weft thread in a traveling wave shedding loom, comprising: a stationary reed for dividing warp threads; a rotary shaft; plates secured to said shaft; combs defined by said plates and arranged helically along said shaft; said plates of at least one comb being made and arranged relative to plates of other combs in such a manner that, during rotation of the shaft, the plane of revolution of at least a portion of each plate of the comb is displaced along the shaft away from the plane of revolution of plates of other combs.

2. An apparatus according to claim 1, wherein said plates of at least one of said combs are installed in opposed relationship to the teeth of the stationary reed and are arranged at substantially the same spacing.

3. An apparatus according to claim 1, wherein said combs in which the planes of revolution of the plates are different are spaced apart in such a manner that the distance from the axis of rotation of the shaft to an imaginary line tangent to the plates of the combs is greater than the distance to the shed branch which is the most remote from the axis of rotation of the shaft.

4. An apparatus according to claim 1, wherein the edge of each plate which is most remote from the axis of rotation of the shaft does not extend in parallel with the plane of revolution of the plates.

5. An apparatus according to claim 1, wherein said plates of different combs are rigidly interconnected to form an integral part having a common base.

* * * * *